US009267775B1

(12) United States Patent
Kleinschmit

(10) Patent No.: US 9,267,775 B1
(45) Date of Patent: Feb. 23, 2016

(54) BULLET FEED DIE ASSEMBLY

(71) Applicant: Hornady Manufacturing Company, Grand Island, NE (US)

(72) Inventor: Nicholas Noel Kleinschmit, Grand Island, NE (US)

(73) Assignee: HORNADY MANUFACTURING COMPANY, Grand Island, NE (US)

( * ) Notice: Subject to any disclaimer, the term of this patent is extended or adjusted under 35 U.S.C. 154(b) by 0 days.

(21) Appl. No.: 14/455,516

(22) Filed: Aug. 8, 2014

(51) Int. Cl.
*F42B 33/00* (2006.01)

(52) U.S. Cl.
CPC ..... *F42B 33/001* (2013.01)

(58) Field of Classification Search
CPC ..... F42B 33/00; F42B 33/001; F42B 33/002
USPC ..... 86/23, 43, 45
See application file for complete search history.

(56) References Cited

U.S. PATENT DOCUMENTS 2,523,278 A * 9/1950 Emerson Jr. ..... 86/45
3,336,830 A * 8/1967 Lester Jr. ..... 86/43
5,179,243 A * 1/1993 Schroeder ..... 86/25
2002/0121184 A1* 9/2002 Fowler ..... 86/45
2010/0275762 A1* 11/2010 Koch et al. ..... 86/43
2011/0083546 A1* 4/2011 Palkowitsh ..... 86/24

* cited by examiner

*Primary Examiner* — Bret Hayes

(74) *Attorney, Agent, or Firm* — Langlotz Patent & Trademark Works, Inc.; Bennet K. Langlotz

(57) ABSTRACT

Bullet feed die assemblies include a case retention station operable to retain the case in a position defining a columnar space above a casemouth of the case, the columnar space defining a primary axis, a bullet insertion facility aligned with the primary axis, the case retention station and bullet insertion facility being relatively movable with respect to each other along the axis between a first separated position and a second proximate position, the bullet insertion facility including a stem aligned with the primary axis, the stem having a lower end operable to press the bullet into a mouth of the case, and the lower end of the stem being laterally movable such that a bullet pushes the stem aside upon entering the columnar space. The bullet insertion facility may include a support element on the primary axis, and the stem may be pivotally connected to the support element.

20 Claims, 20 Drawing Sheets

BULLET FEED DIE ASSEMBLY

FIELD OF THE INVENTION

The present invention relates to ammunition manufacturing machinery, and more particularly to feeding of bullets into cartridges of different lengths.

BACKGROUND OF THE INVENTION

Modern rifle and handgun cartridges have four components: the cartridge case, the primer, the propellant, and the bullet. The most costly and critical component of a cartridge is the case. Not only does it hold all of the other components, but the case provides a precision seal that ensures expanding gases remain in the firearm and efficiently push the bullet out of the firearm's barrel.

The brass case is often capable of being reused several times before it is no longer suitable for use. Because the case accounts for about 65% of the cost of ammunition, many shooters are therefore motivated to reduce their cost per shot by reloading spent cases for reuse.

However, reducing the cost per shot is not the only factor motivating the reloading of spent cases. Reloaders are able to custom tune the reloaded ammunition to their firearm's particular characteristics. Adjusting the cartridge length to the maximum the firearm will allow can greatly improve accuracy, as can loading the cartridge with a particular bullet weight or style. Furthermore, a reloader can safely assemble reduced velocity ammunition that will subject an inexperienced shooter to less recoil. Finally, reloading enables owners of obsolete firearms to continue to shoot even when factory ammunition is no longer available.

The process of reloading ammunition requires a reloading press, powder measure, priming system, calipers, scale, and a set of reloading dies. The press is a specialized device designed expressly for reloading ammunition. It holds the reloading dies in precise alignment and provides mechanical advantage required to recondition the cartridge case.

The reloading dies, which typically are a sizing die and a seating die, are customized for the case they are intended to load. The sizing die reshapes the case to the dimensions needed to permit easy chambering. The sizing die also ejects the spent primer by the use of a decaping pin attached to a spindle and ensures the case's mouth is the proper diameter to receive a new bullet when a pistol case is being reloaded. If a rifle case is being reloaded, there is an expander ball on the spindle. The seating die aligns the bullet with the case and pushes it into the case to the desired depth.

In conventional practice, a bullet is placed on the mouth of a charged case and is held in place by the reloader's thumb and forefinger. The case head is placed atop the ram of the press. The ram is raised, pushing the casing neck into the seating die. As this occurs, the user releases the bullet and gives the press handle a full stroke to seat the bullet in the case.

The conventional approach suffers the disadvantage of requiring the user to manually hold a bullet on the mouth of a charged case while raising the ram. This creates the potential for injury and increases the time required to reload a casing. And, especially in the case of rifle case reloading, any imprecision in the alignment of the bullet with the casing can result in inaccuracy when the reloaded case is fired. Other conventional bullet feeding mechanisms exist, but are mechanically complex, unreliable, or expensive. In the case of rifle case reloading, other conventional bullet feeding mechanisms are often limited to loading only rifle cases of a specific length.

Therefore, a need exists for a new and improved bullet feed die assembly that feeds bullets into cartridges of different lengths. In this regard, the various embodiments of the present invention substantially fulfill at least some of these needs. In this respect, the bullet feed die assembly according to the present invention substantially departs from the conventional concepts and designs of the prior art, and in doing so provides an apparatus primarily developed for the purpose of feeding bullets into cartridges of different lengths.

SUMMARY OF THE INVENTION

The present invention provides an improved bullet feed die assembly, and overcomes the above-mentioned disadvantages and drawbacks of the prior art. As such, the general purpose of the present invention, which will be described subsequently in greater detail, is to provide an improved bullet feed die assembly that has all the advantages of the prior art mentioned above.

To attain this, the preferred embodiment of the present invention essentially comprises a case retention station operable to retain the case in a position defining a columnar space above a casemouth of the case, the columnar space defining a primary axis, a bullet insertion facility aligned with the primary axis, the case retention station and bullet insertion facility being relatively movable with respect to each other along the axis between a first separated position and a second proximate position, the bullet insertion facility including a stem aligned with the primary axis, the stem having a lower end operable to press the bullet into a mouth of the case, and the lower end of the stem being laterally movable such that a bullet pushes the stem aside upon entering the columnar space. The bullet insertion facility may include a support element on the primary axis, and the stem may be pivotally connected to the support element. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
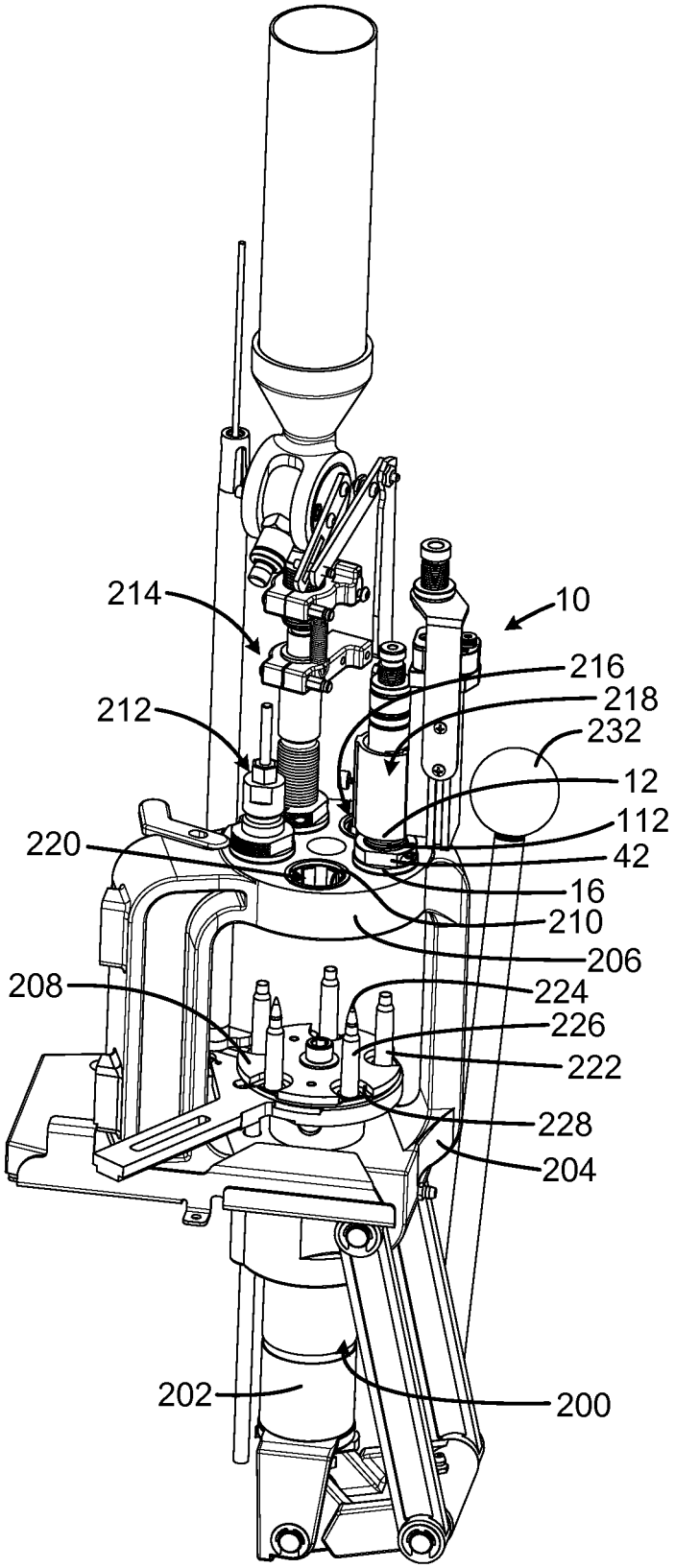
FIG. 1 is a top isometric view of the current embodiment of the bullet feed die assembly constructed in accordance with the principles of the present invention installed in a reloading press.

A preferred embodiment of the bullet feed die assembly of the present invention is shown and generally designated by the reference numeral 10.

FIG. 1 illustrates the improved bullet feed die assembly 10 of the present invention installed in a reloading press 200. More particularly, the press has horizontally-oriented and parallel spaced-apart upper and lower frame portions 206 and 204. The upper frame portion has five threaded tool stations (212, 214, 216, 218, and 220) mounted on it. The lower frame portion receives a reciprocating ram 202. A shell plate 208 with five case retention stations or shell holders 228 is rotatably mounted on top of the ram. The plate positions the shell holders such that the cartridges or cases 222 in the shell holders are axially registered with the five tool stations.

In use, the user places an empty case in the shell holder positioned beneath the first station 212. After giving the press handle 232 a full stroke, a first case 222 is sized and its spent primer is removed by the first station.

The first case 222 is then moved to the second station 214 by rotating the plate 208. The plate is rotated mechanically on some presses. An additional empty case is then inserted at the first tool station, which happens after each stage of operation to provide efficient progressive operation. After giving the press handle 232 another full stroke, the first case is primed and loaded with a measured quantity of powder by the second tool station 214.

This now charged case 222 is then moved to the third tool station 216 by rotating the plate 208. The plate is rotated mechanically on some presses. Although the press handle 232 is given another full stroke to perform operations at the other occupied tool stations, no activity occurs with the charged case since the third tool station is unoccupied.

The charged case 222 is then moved to the fourth tool station 218, which is a bullet insertion facility, by rotating the plate 208. The plate is rotated mechanically on some presses. After giving the press handle 232 a full stroke, the charged case receives a single rifle bullet 224 from the bullet feed die assembly 10 positioned at the fourth tool station. In addition to feeding a bullet, the bullet feed die assembly also seats the bullet and crimps the neck of the cartridge while the press handle is given a full stroke. The bullet feed die assembly is not necessarily always located in the fourth station; the bullet feed die assembly's location depends on how many stations the press that is being used possesses.

The resulting reloaded cartridge 226 is then moved to the fifth tool station 220 by rotating the plate 208. The plate is rotated mechanically on some presses. Although the press handle is given another full stroke to perform operations at the other occupied tool stations, no activity occurs with the reloaded cartridge since the fifth tool station is unoccupied. The reloaded cartridge 226 can be removed from its shell holder 228 and is ready for use.

The bullet feed die assembly 10 is an elongated cylindrical body having mounting threads 112 on the bottom 16 of its bullet feed die 12. These threads are screwed into a threaded bore or socket 210 in the upper frame portion 206 of the press 200 at the appropriate tool station. The bullet feed die assembly will work with any press that has a ⅞-14 thread. A lock ring 42 functions as a lock nut and releasably secures the bullet feed die to the press by locking against the upper surface of the upper frame portion or against the top surface of the socket in the press. When installed in this manner, the die assembly serves as the third of five ammunition reloading tool stations on the press. However, the bullet feed die assembly's location depends on the press's design and can vary. Components for the other tool stations on the press are installed on the upper frame portion in a similar manner.

Figure 2:
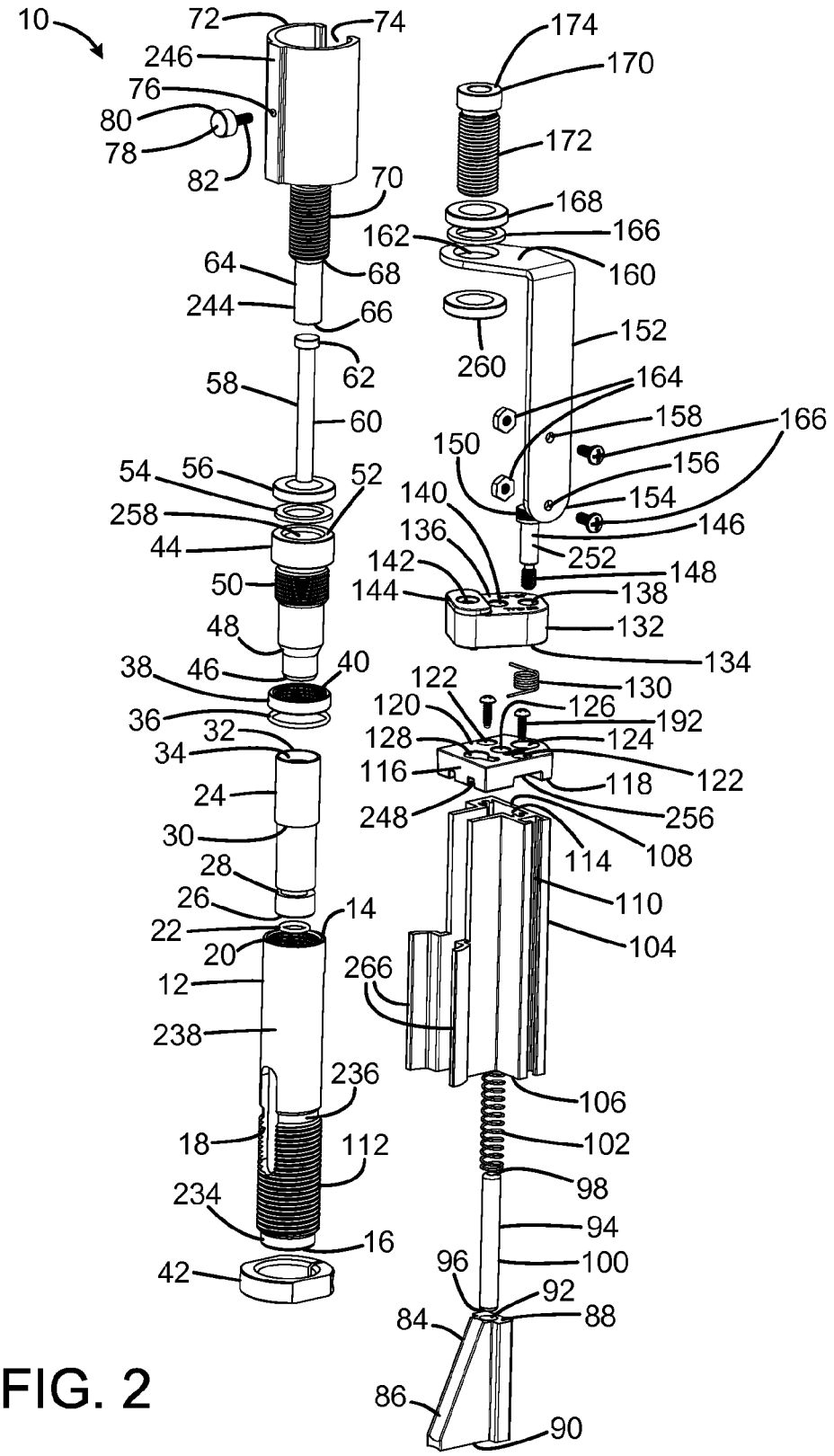
FIG. 2 is a top isometric exploded view of the current embodiment of the bullet feed die assembly of the present invention.

FIG. 2 illustrates the improved bullet feed die assembly 10 of the present invention. The feed assembly essentially serves to drop a single rifle bullet into each case as the press is cycled, but also aligns the bullet and crimps the neck of the cartridge. More particularly, the feed assembly consists of a bullet feed die body 12, an alignment sleeve 24, a crimp adjust screw 44, a seating stem 58, a seat adjust screw 64, a feeder clamp 72, a bullet ramp 84, a dowel pin 94, a compression spring 102, a feeder body 104, a feeder cap 116, a torsion spring 130, a feed block 132, a shoulder bolt 146, a feed support bracket 152, and a feed tube retainer 170.

The bullet feed die body 12 is a generally tube-shaped body that is open at both the top 14 and bottom 16. The top opening is a threaded bore 20. The exterior of the bottom 16 of the bullet feed die body has a short smooth section 234 with a threaded portion 112 located immediately above. A groove 236 separates an upper smooth portion 238 from the threaded portion. A slot 18 extends longitudinally from the lower part of the upper smooth portion, across the groove, and terminates in the threaded portion. The threaded portion 112 threadedly engages the socket 210 of the press 200 and the lock ring 42.

The alignment sleeve 24 is a generally tube-shaped body that is open at the top 32 and bottom 26. The exterior of the alignment sleeve is smooth with a groove 28 adjacent to the bottom and a shoulder 30 located approximately midway between the groove and the top. A bullet retaining O-ring 22 is received within the groove. The alignment sleeve is sized to closely fit within the bullet feed die body 12.

The crimp adjust screw 44 is a generally tube-shape body with an open bore 258 that is open at the top 52 and bottom 46. The exterior of the crimp adjust screw is smooth adjacent to the bottom and has a tapered portion 48. A threaded portion 50 is located above the tapered portion and below the top. The threaded portion threadedly engages a crimp adjust lock ring 38, and a crimp adjust lock ring O-ring receives the bottom of the crimp adjust screw. A rubber washer 54 and a seat adjust lock ring 56 sit above the top of the crimp adjust screw.

The seating stem 58 has a rigid elongated member or shaft 60 with an enlarged head 62. The seating stem is sized such that the shaft 60 can pass through the opening in the bottom 46 of the crimp adjust screw, but the enlarged head cannot. The bottom of the shaft has a bore 198 with a tapered mouth (shown in FIGS. 5-20).

The seat adjust screw 64 is a generally tube-shape body with a top 242 (shown in FIGS. 5-20) and a bottom 66. The exterior has a smooth lower portion 244 and a threaded portion 70 with a tapered portion 68 in between them. The seat adjust screw is sized to be received within the top 52 of the crimp adjust screw 44. The rubber washer 54 and seat adjust lock ring 56 are engaged with the threaded portion of the seat adjust screw.

The feeder clamp 72 is a generally cylindrical body with a wide longitudinal slot 74 and an opposing raised portion 246. The raised portion defines an aperture 76. The aperture receives the threaded portion 82 of a thumbscrew 78 having a head 80.

The bullet ramp 84 is a generally triangular body with a top 88 and a bottom 90. The top 88 defines a bore 92. A sloped surface 86 extends outward from the top to the bottom of the bullet ramp.

The dowel pin 94 is an elongate generally cylindrical body with a top 98 and a bottom 96. The bottom 96 is received within the bore 92 in the top 88 of the bullet ramp 84. A compression spring 102 encircles the exterior 100 of the dowel pin.

The feeder body 104 is an elongate body that is generally T-shaped in cross-section. The feeder body has a T-shaped central bore 114 that extends from the top 108 to the bottom 106. Two arms 266 extend outward from the base of the T shape from approximately the middle of the theater body to the bottom. A side channel 110 is formed by one side of the crossbar portion of the T shape and extends from the top to the bottom. The top 98 of the dowel pin 94 and the compression spring 102 are received within the central bore of the feeder body.

The feeder cap 116 is a generally rectangular body that fits over the top 108 of the feeder body 104. The bottom 118 of the feeder cap defines slots 248 and 250 that receives the top of the feeder body. The top 120 of the feeder cap defines screw holes 122 and holes 124, 126, and 128. Two screws 192 removably secure the feeder cap to the top of the feeder body. A torsion spring 130 has one end received within the hole 124.

The feed block 132 is a generally rectangular body that sits on the top 120 of the feeder cap 116. The top 136 of the feed block has a raised portion 144. The top of the feed block defines holes 138, 140, 142, with hole 142 being located within the raised portion.

The shoulder bolt 146 has a bottom threaded portion 148 that extends through the hole 138 in the feed block 132, the center of the torsion spring 130, and is threadedly engaged with the hole 124 in the feeder cap 116. The shoulder bolt has a smooth enlarged exterior portion 252 located below the head 150.

The feed support bracket 152 is an inverted L-shape. The upright portion of the L defines two holes 156, 158 that receive two screws 166. The screws are threadedly engaged with nuts 164 and releasably secure the feed support bracket to the side channel 110 of the feeder body 104. The horizontal portion of the L or top 160 defines a single enlarged hole 162.

The feed tube retainer 170 is a generally tube-shaped body. The exterior of the feed tube retainer is threaded with threads 172 except for the head 174. The threads 172 engage seat adjust lock ring 168 and lock ring 260. The threads also pass through rubber washer 166 and hole 162 in the top 160 of the feed support bracket 152.

Figure 3A:
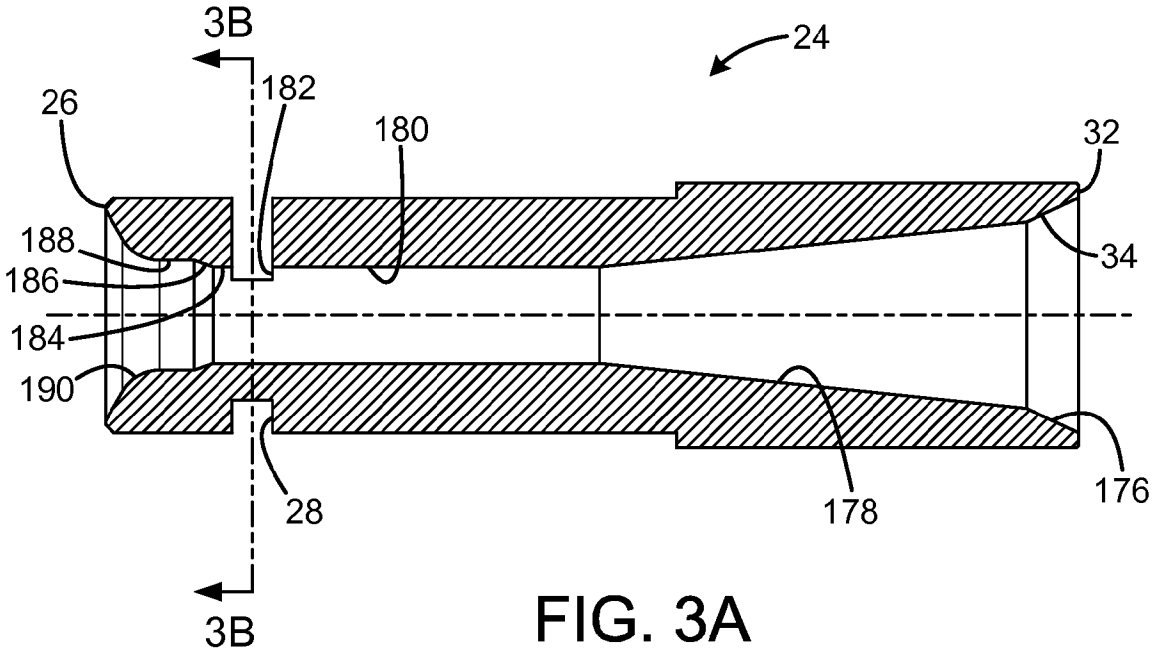
FIG. 3A is a side sectional view of the current embodiment of the alignment sleeve of the present invention.
Figure 3B:
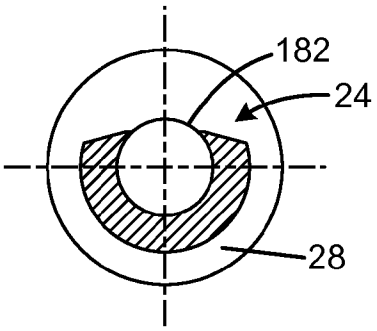
FIG. 3B is a side sectional view of the current embodiment of the alignment sleeve of the present invention taken along lines 3B-3B of FIG. 3A.

FIGS. 3A and 3B illustrate the improved alignment sleeve 24 of the present invention. More particularly, the alignment sleeve has a central bore 34 with various features that serve to align a bullet 224 (shown in FIGS. 5-20) with an empty case 222 (shown in FIGS. 5-20) into crimp the mouth 230 of the case. The top 32 of the bore 34 has a first tapered surface 176 that connects to a narrower second tapered surface 178. The second tapered surface connects to a still narrower first bullet alignment surface 180 of constant diameter. The first bullet alignment surface is separated from a second bullet alignment surface 184 by an interior communication channel 182 within a portion of the groove 28. The interior communication channel enables a portion of the bullet retaining O-ring 22 to penetrate into the central bore of the alignment sleeve when the bullet retaining O-ring is received within the groove. The second bullet alignment surface connects to a tapered crimping surface 186 that in turn connects to a wider case alignment surface 188 of constant diameter. The case alignment surface connects to a radius surface 190 that opens to the bottom 26 of the alignment sleeve.

Figure 4A:
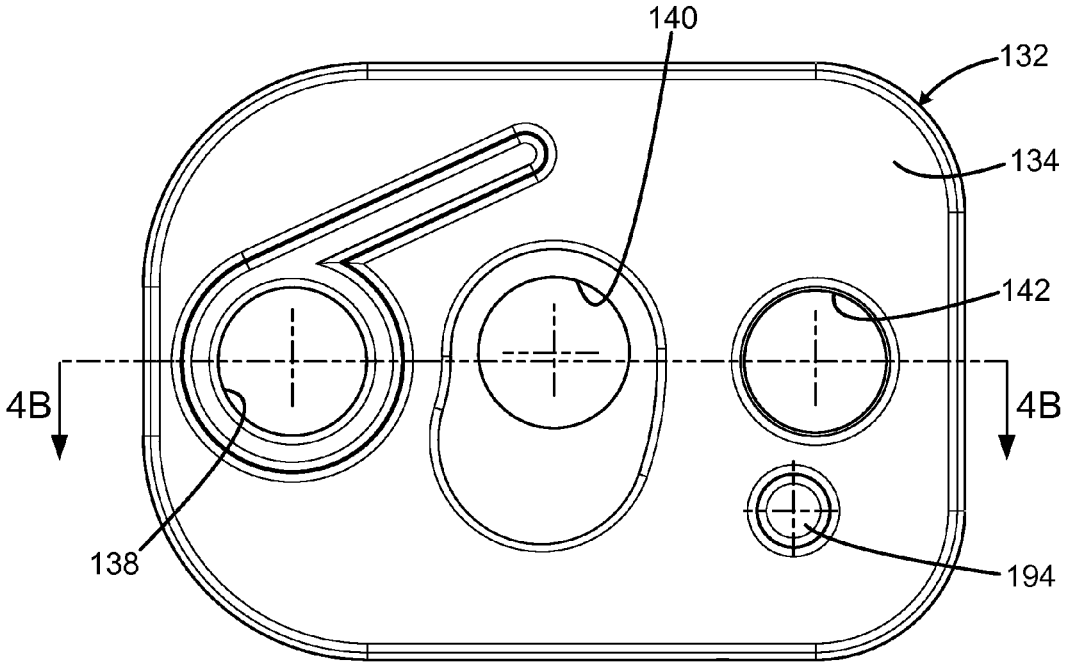
FIG. 4A is a bottom view of the current embodiment of the feed block of the present invention.
Figure 4B:
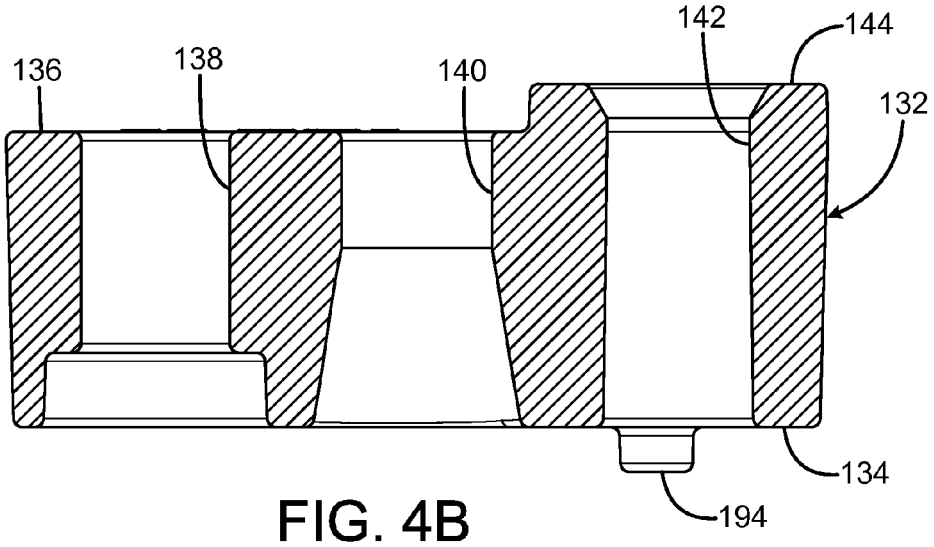
FIG. 4B is a side sectional view of the current embodiment of the feed block of the present invention.

FIGS. 4A and 4B illustrate the improved feed block 132 of the present invention. More particularly, the feed block has three holes 138, 140, 142 that communicate from the top 136 to the bottom 134. Hole 138 is substantially of constant diameter until reaching the bottom of the feed block, where hole 138 opens into a substantially wider opening that receives the uppermost portion of the torsion spring 130. Hole 140 is of substantially constant diameter at the top and opens into a wider, kidney-shaped opening at the bottom of the feed block. The kidney-shaped opening receives the top 98 of the dowel pin 94, which hits on one edge of the kidney-shaped opening.

Hole 142 begins within the raised portion 144 at the top of the feed block. Hole 142 tapers to a narrower portion of constant diameter within the remainder of the feed block. A protrusion 194 extends downward from the bottom of the feed block adjacent to hole 142.

FIGS. 5-20 illustrate the improved bullet feed die assembly 10 installed in the socket 210 of the upper frame portion 206 of a reloading press 200. More particularly, the process of reloading an empty case 222 is depicted. The alignment sleeve 24 is fixed axially within the die body 12, but can slide up and down. A new bullet 224 is also fixed axially within the alignment sleeve, but can slide up and down. The die body threads up and down within the lock ring 42 to adjust for longer or shorter empty cases, but does not move during operation of the reloading press. The feeder clamp 72 and feeder body 104 are also fixed with respect to the reloading press. In the current embodiment, the bullet feed die assembly is sized and positioned to reload 0.223 Remington® cartridges. However, the bullet feed die assembly can be sized and positioned to reload shorter cartridges such as 0.221 Remington® Fireball and longer cartridges such as 0.22-6 mm.

Figure 5:
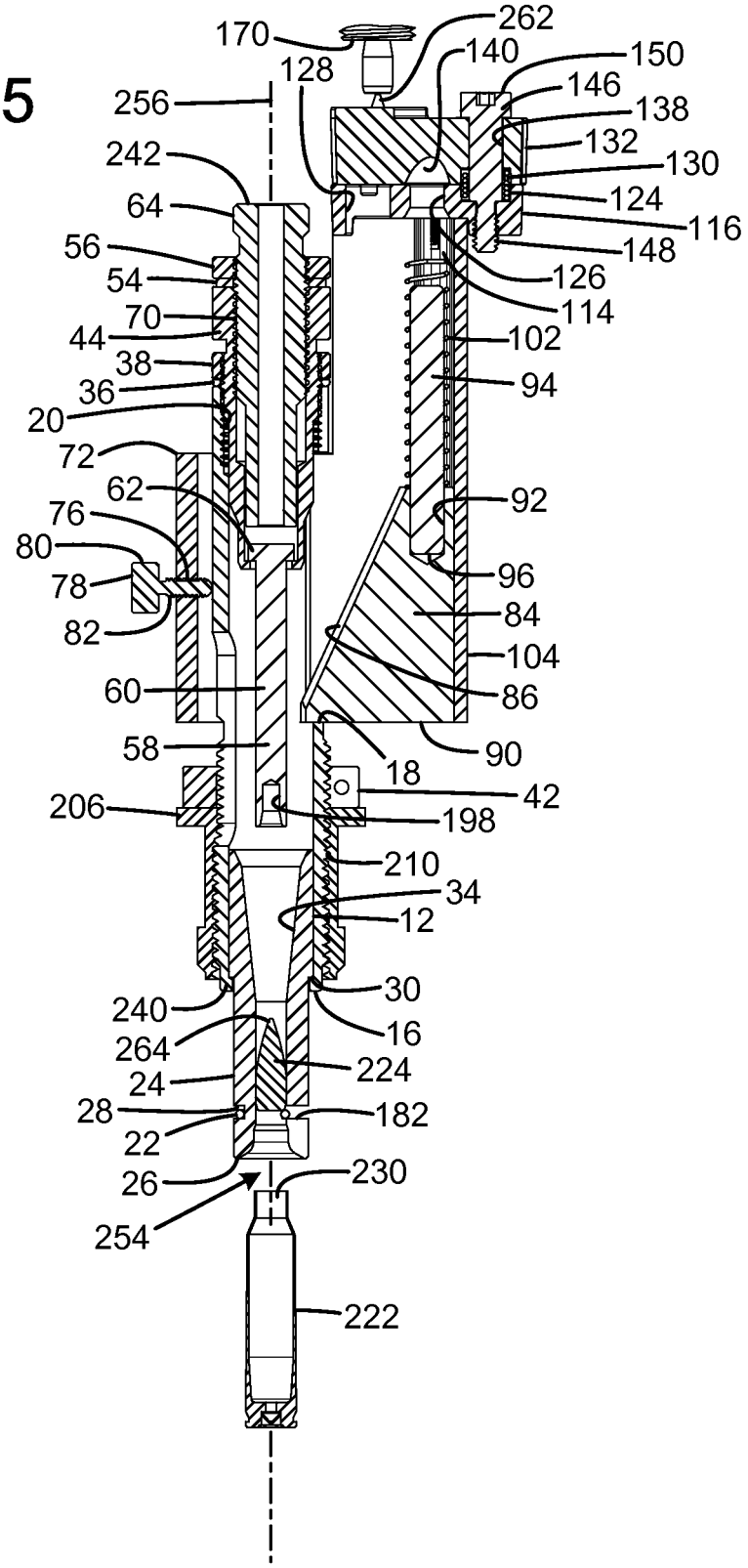
FIG. 5 is a side sectional view of the bullet feed die assembly of FIG. 2 with the reloading press in the starting position.

In FIG. 5, the empty case 222 begins to travel upward towards the bottom 26 of the alignment sleeve 24 as the handle 232 of the press 200 is pulled downward to raise the ram 202. The position of the empty case defines a columnar space 254 above the casemouth 230, and the columnar space defines a primary axis 256. The case retention station and the bullet insertion facility are relatively movable with respect to each other along the axis between a first separated position and a second proximate position. The new bullet 224 rests within the central bore 34 of the alignment sleeve against the portion of the bullet retaining O-ring 22 that penetrates the bore via the interior communication channel 182.

Figure 6:
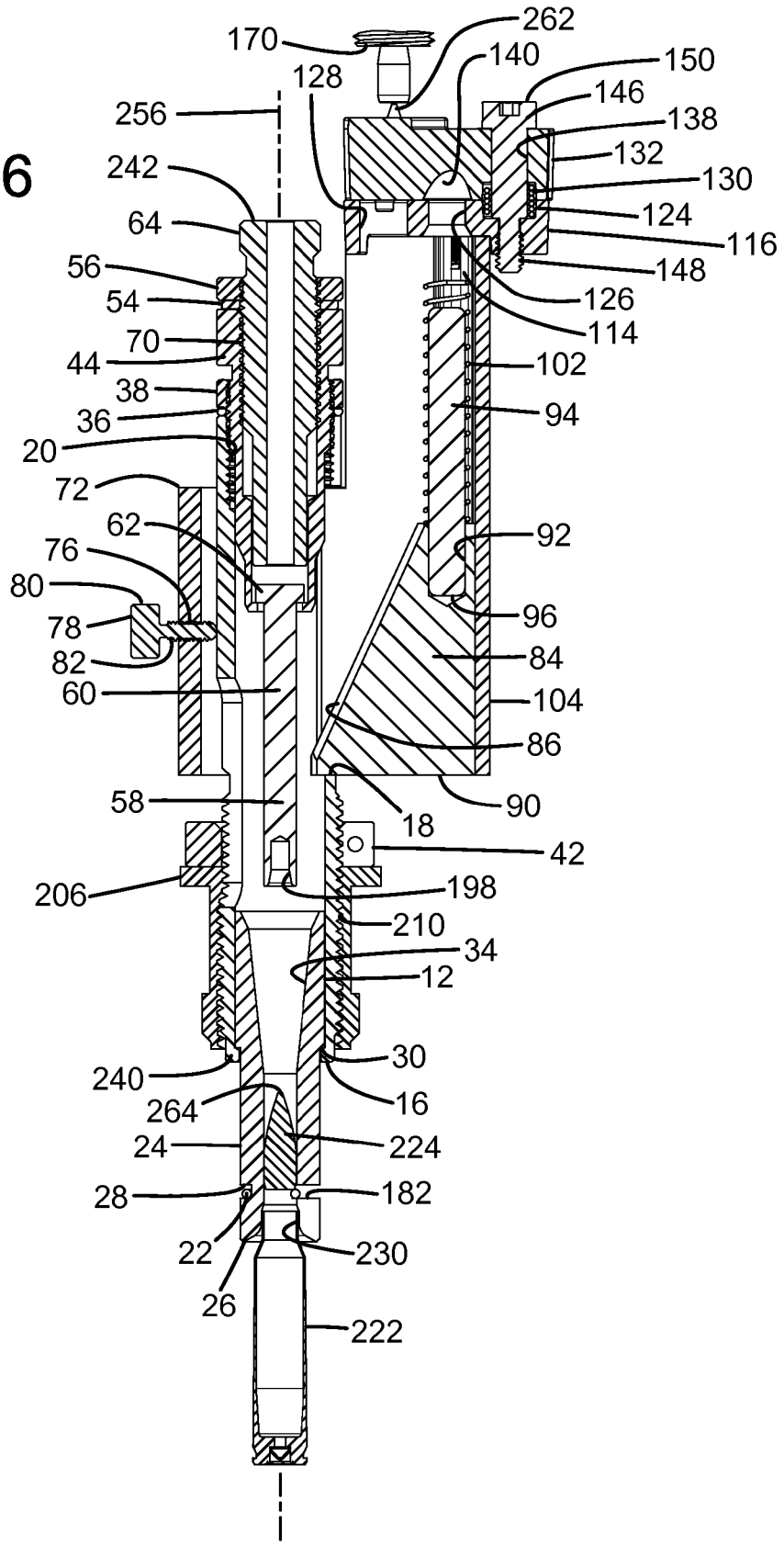
FIG. 6 is a side sectional view of the bullet feed die assembly of FIG. 2 with the reloading press having moved upward relative to FIG. 5 until the mouth of the cartridge has contacted the crimp location.

In FIG. 6, the empty case 222 has traveled further upward until the mouth 230 of the empty case contacts and pushes against the tapered crimping surface 186 within the central bore 34 of the bottom 26 of the alignment sleeve 24.

Figure 7:
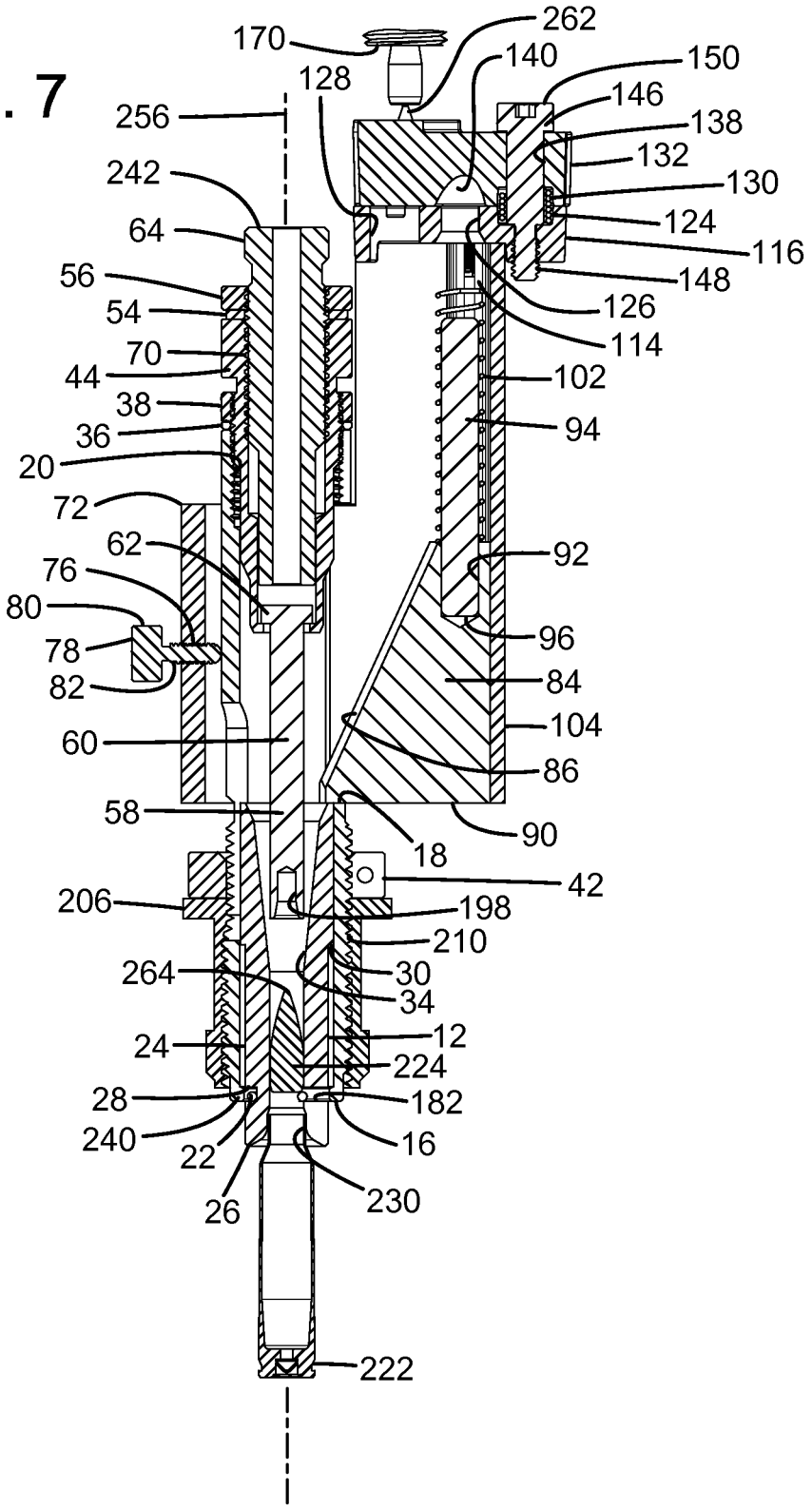
FIG. 7 is a side sectional view of the bullet feed die assembly of FIG. 2 with the reloading press having moved upward relative to FIG. 6 until the top of the alignment sleeve has contacted the bottom of the feed ramp.

In FIG. 7, the empty case 222 has traveled further upward and has pushed the alignment sleeve 24 upward until the top 32 of the alignment sleeve contacts the bottom 90 of the bullet ramp 84. As the alignment sleeve has risen, the shaft 60 of the seating stem 58 has entered the bore 34 in the top of the of the alignment sleeve. The shaft of the seating stem is initially aligned with the primary axis 256, with the bore 198 in the lower end of the shaft being operable to press the new bullet into the mouth 230 of the empty case. The seating stem is pendular, and the lower end of the stem is aligned with the primary axis in the absence of a lateral force.

Figure 8:
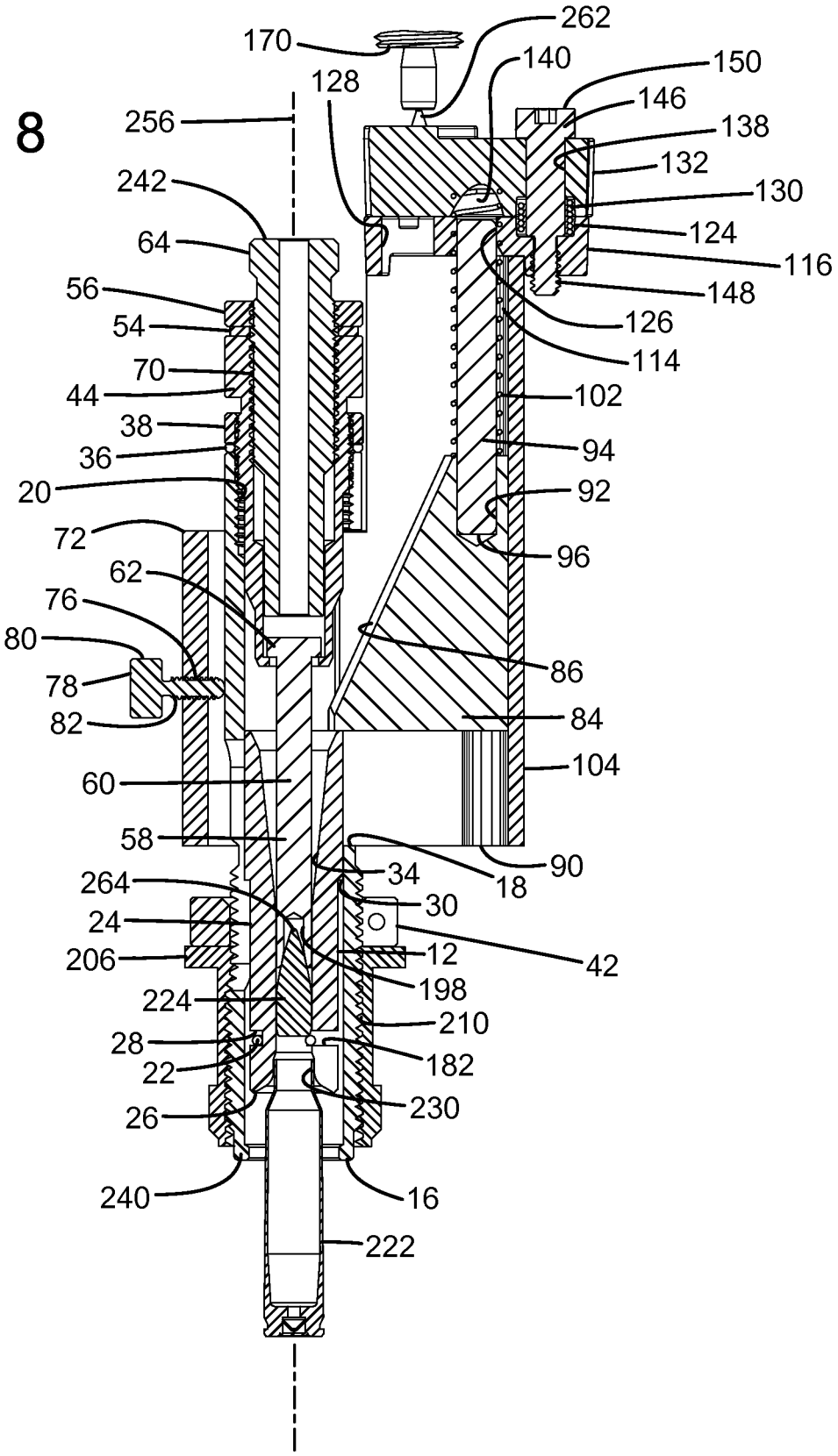
FIG. 8 is a side sectional view of the bullet feed die assembly of FIG. 2 with the reloading press having moved upward relative to FIG. 7 until the bullet has contacted the seating stem.

In FIG. 8, the empty case 222 has traveled further upward and has pushed the alignment sleeve 24 and bullet ramp 84 further upward. The continued upward movement of the alignment sleeve has caused a greater portion of the shaft 60 of the seating stem 58 to enter the bore 34 in the top 32 of the alignment sleeve. The bore 198 in the bottom of the shaft of the seating stem receives the nose 264 of the new bullet 224.

Figure 9:
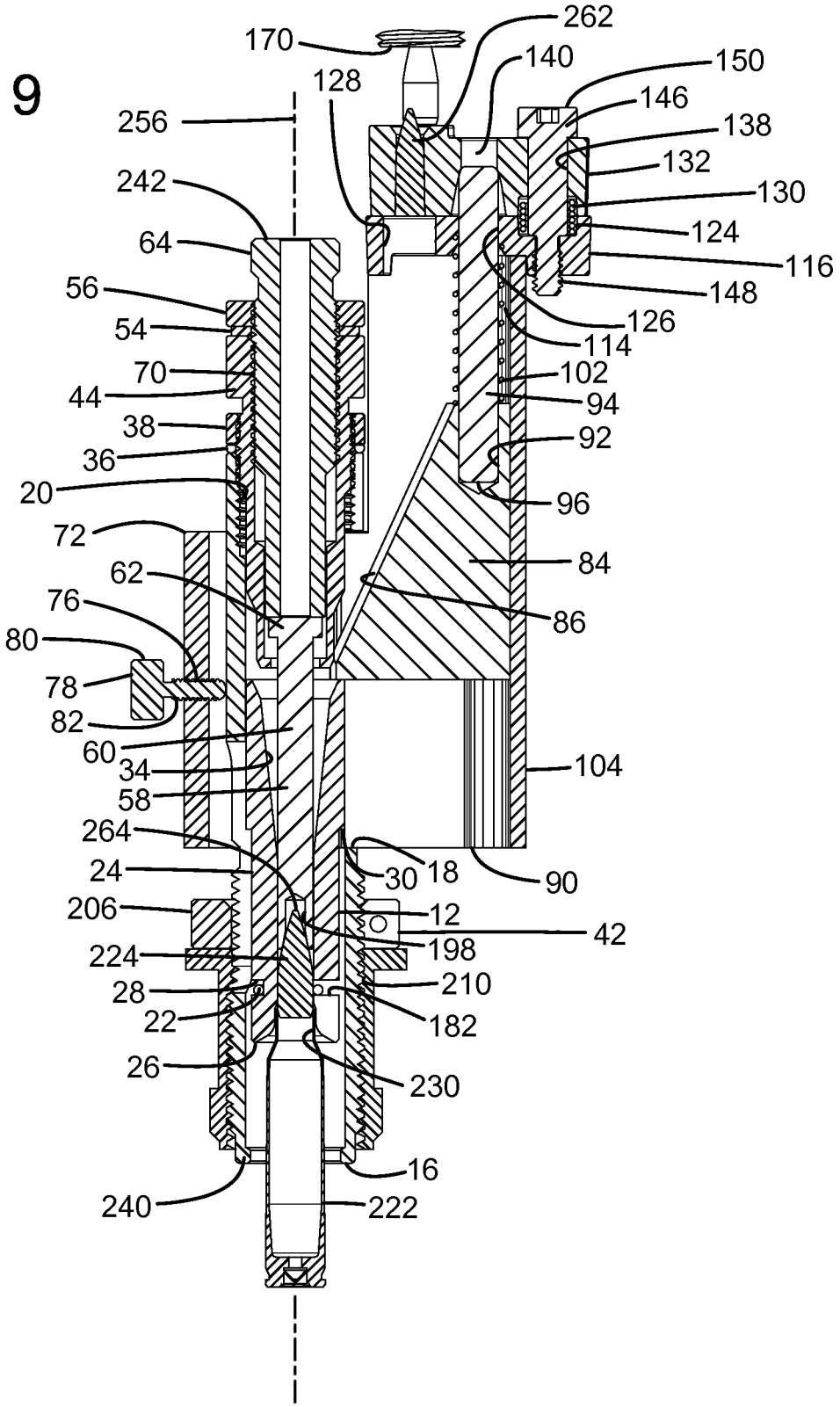
FIG. 9 is a side sectional view of the bullet feed die assembly of FIG. 2 with the reloading press having moved upward relative to FIG. 8 until the bullet has contacted the mouth of the cartridge. The bullet pushes the seating stem up, and then is pushed past the O-ring.

In FIG. 9, the empty case 222 has traveled further upward and has pushed the alignment sleeve 24 and the bullet ramp 84 further upward. The continued upward movement of the alignment sleeve has caused the head 62 of the seating stem 58 to be pushed upward by contact between the new bullet 224 and the shaft 60 until the head's upward movement is limited by contact with the bottom 66 of the seat adjust screw 64. The resulting axial force the seating stem is operable to transmit or exert on the new bullet begins to push the bullet pass the bullet retaining O-ring 22 and causes the bullet to begin to seat within the mouth 230 of the empty case. The continued upward movement of the bullet ramp 84 and the resulting upward movement of the dowel pin 94 has caused the feed block 132 to pivot on the shoulder bolt 146. The pivoting movement of the feed block is caused by interaction of the top 98 of the dowel pin with the kidney-shaped opening of hole 140 in the bottom 134 of the feed block. The pivoting movement of the feed block moves the next bullet 262 in the hole 142 in the feed block towards the hole 128 in the feeder cap.

Figure 10:
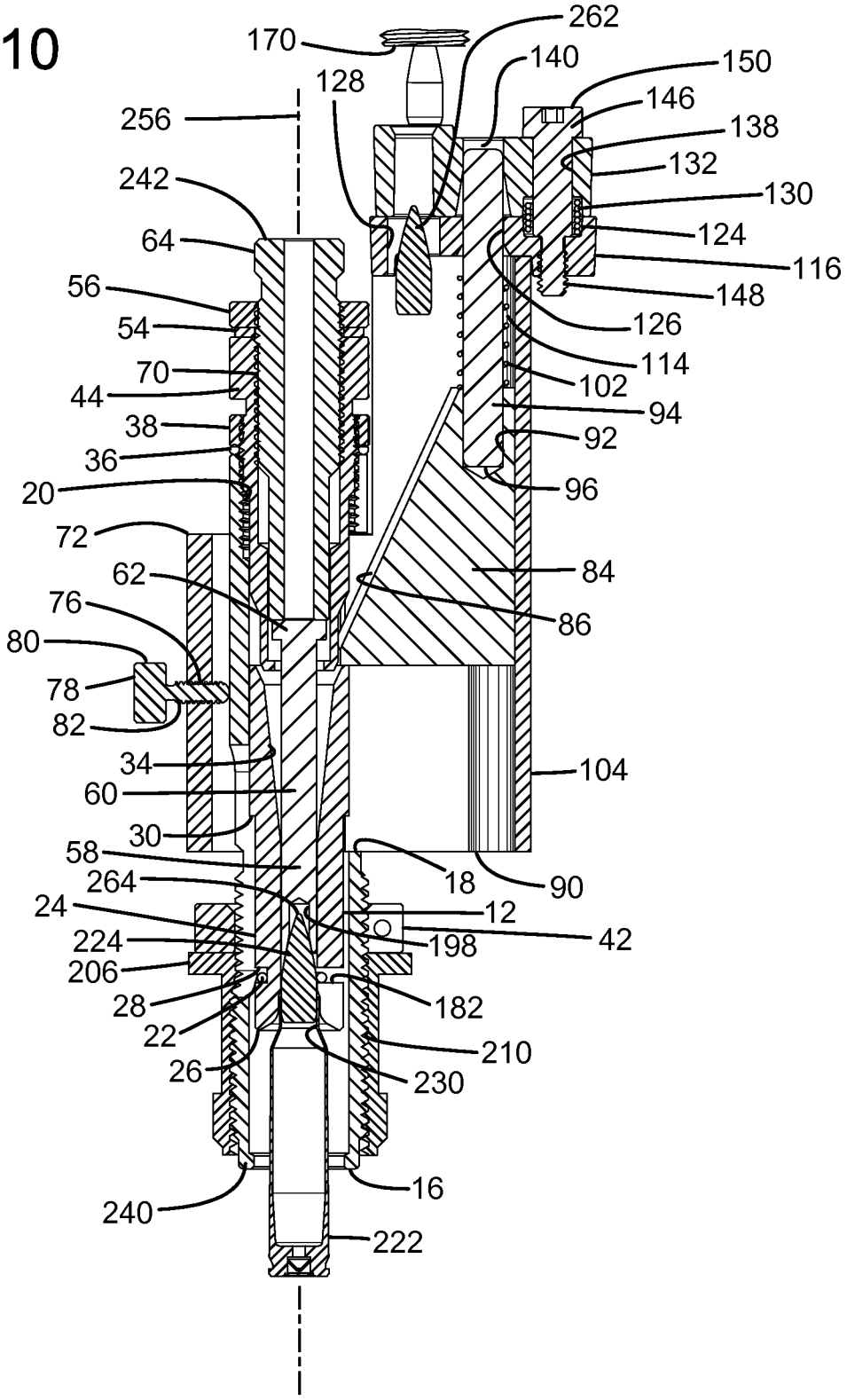
FIG. 10 is a side sectional view of the bullet feed die assembly of FIG. 2 with the reloading press having moved upward relative to FIG. 9 until the next bullet has dropped from the feed tube retainer.

In FIG. 10, the empty case 222 has traveled further upward and has pushed the alignment sleeve 24 and the bullet ramp 84 further upward. The increased force exerted on the new bullet by contact between the seating stem 58 and the seat adjust screw 64 continues to seat the new bullet within the mouth 230 of the empty case. Continued pivoting movement of the feed block has axially registered the hole 142 in the feed block with the hole 128 in the feeder cap, which enables the next bullet 262 to drop into the bore 114 of the feeder body 104. The next bullet drops near the top of the stroke of the ram 202 of the reloading press 200.

Figure 11:
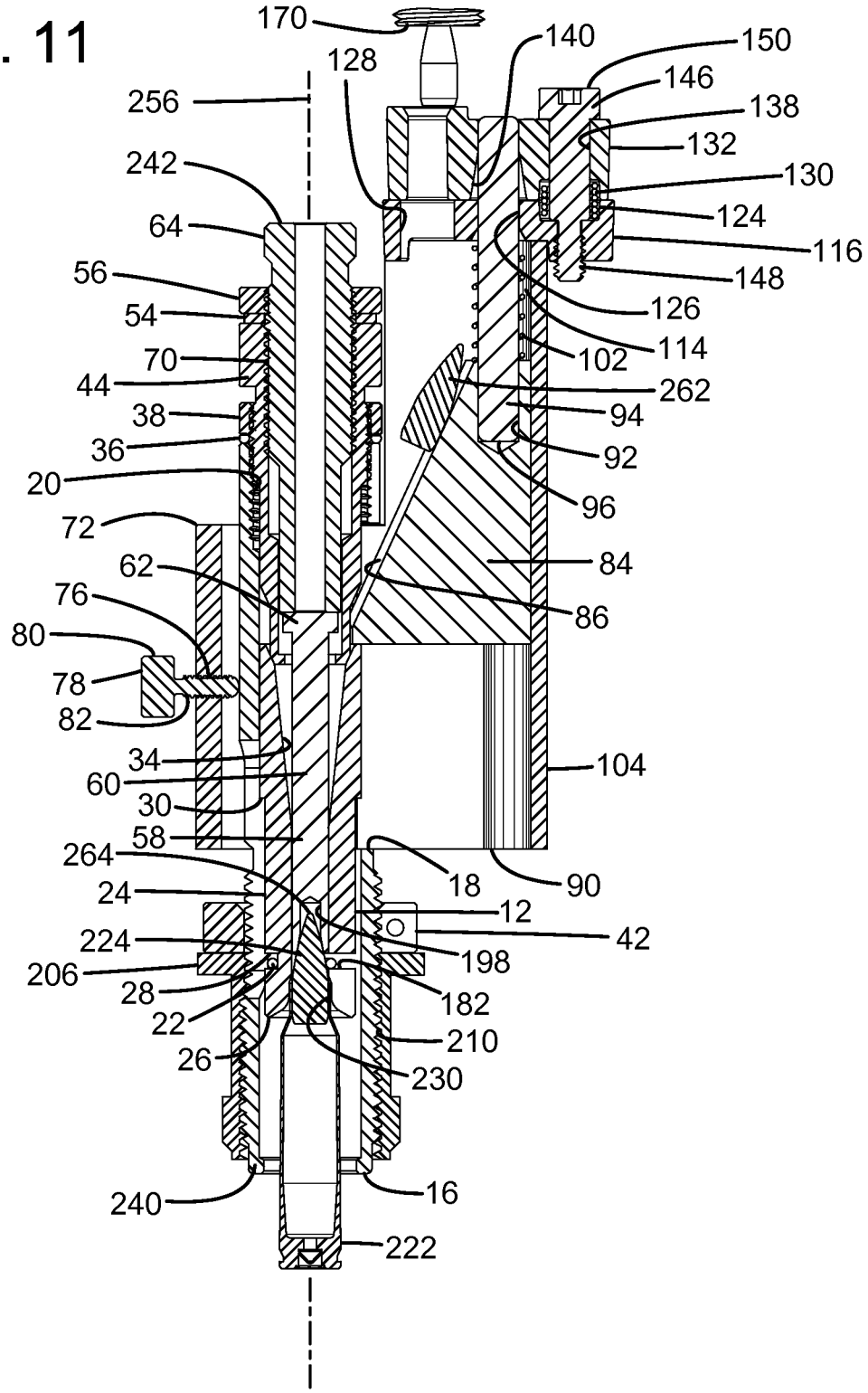
FIG. 11 is a side sectional view of the bullet feed die assembly of FIG. 2 with the reloading press having moved upward relative to FIG. 10 until the bottom of the crimp adjust screw has contacted the top of the alignment sleeve.

In FIG. 11, contact between the top 32 of the bore 34 of the alignment sleeve 24 and the tapered bottom 46 of the crimp adjust screw 44 determines the top of the stroke of the ram 202 of the reloading press 200. The new bullet 224 is seated in the mouth 230 of the reloaded case 222, and the mouth has been crimped by the tapered crimping surface 186 in the bottom 26 of the bore 34 of the alignment sleeve. The next bullet 262 has reached the sloped surface 86 of the bullet ramp 84. The sloped surface begins to guide the next bullet towards the slot 18 in the die body 12 along a bullet feed path that enters the columnar space 254 and intersects the primary axis 256 at a position above the lower end of the seating stem 58.

Figure 12:
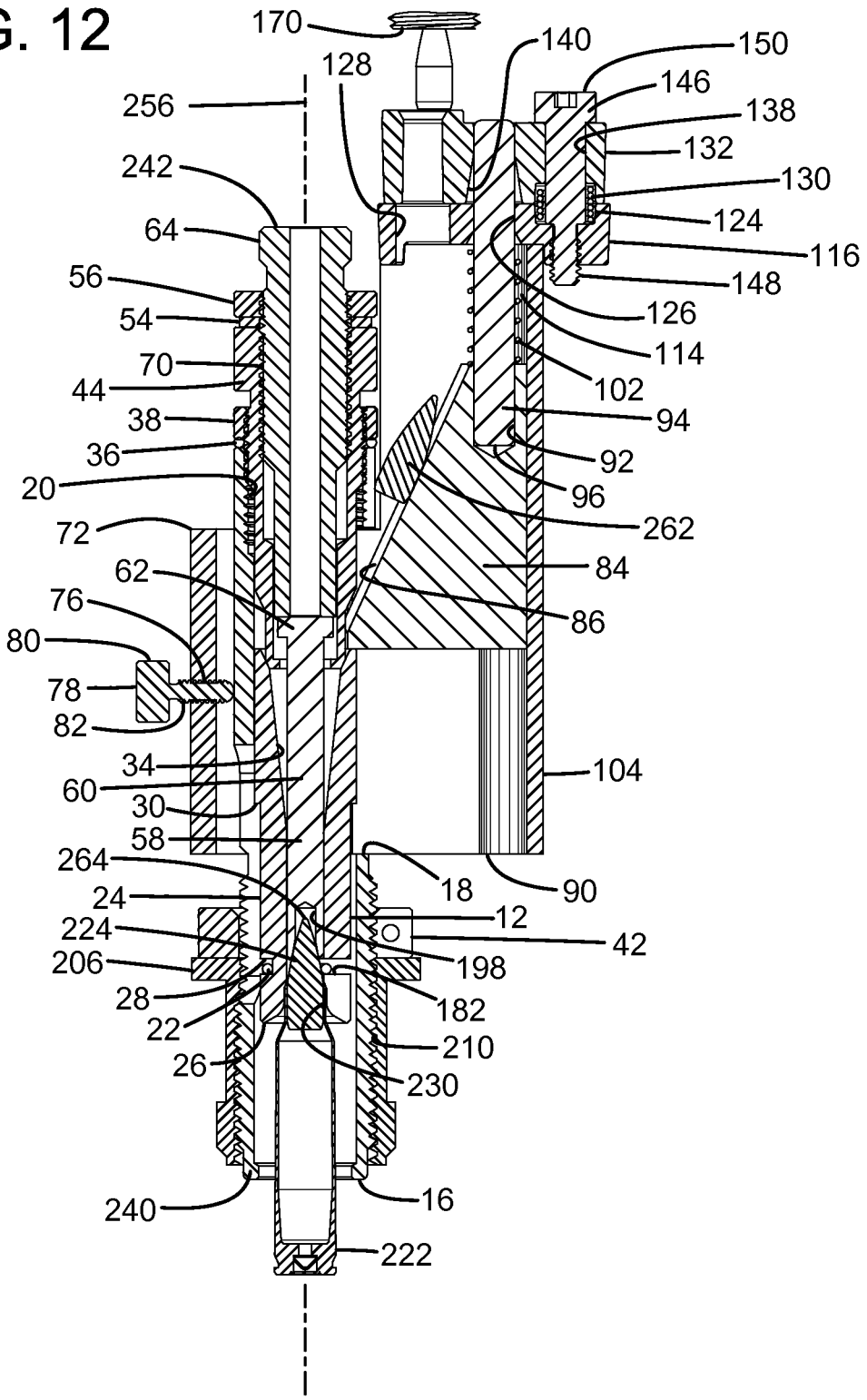
FIG. 12 is a side sectional view of the bullet feed die assembly of FIG. 2 with the reloading press having remain stationary relative to FIG. 11 and the seating stem.

In FIG. 12, the sloped surface 86 of the bullet ramp 84 has guided the next bullet 262 towards the slot 18 in the die body 12 while the ram 202 of the reloading press 200 is at the top of the stroke. The raised position of the bullet ramp relative to the slot in the die body causes the next bullet to come to rest against the smooth exterior portion 238 of the die body.

Figure 13:
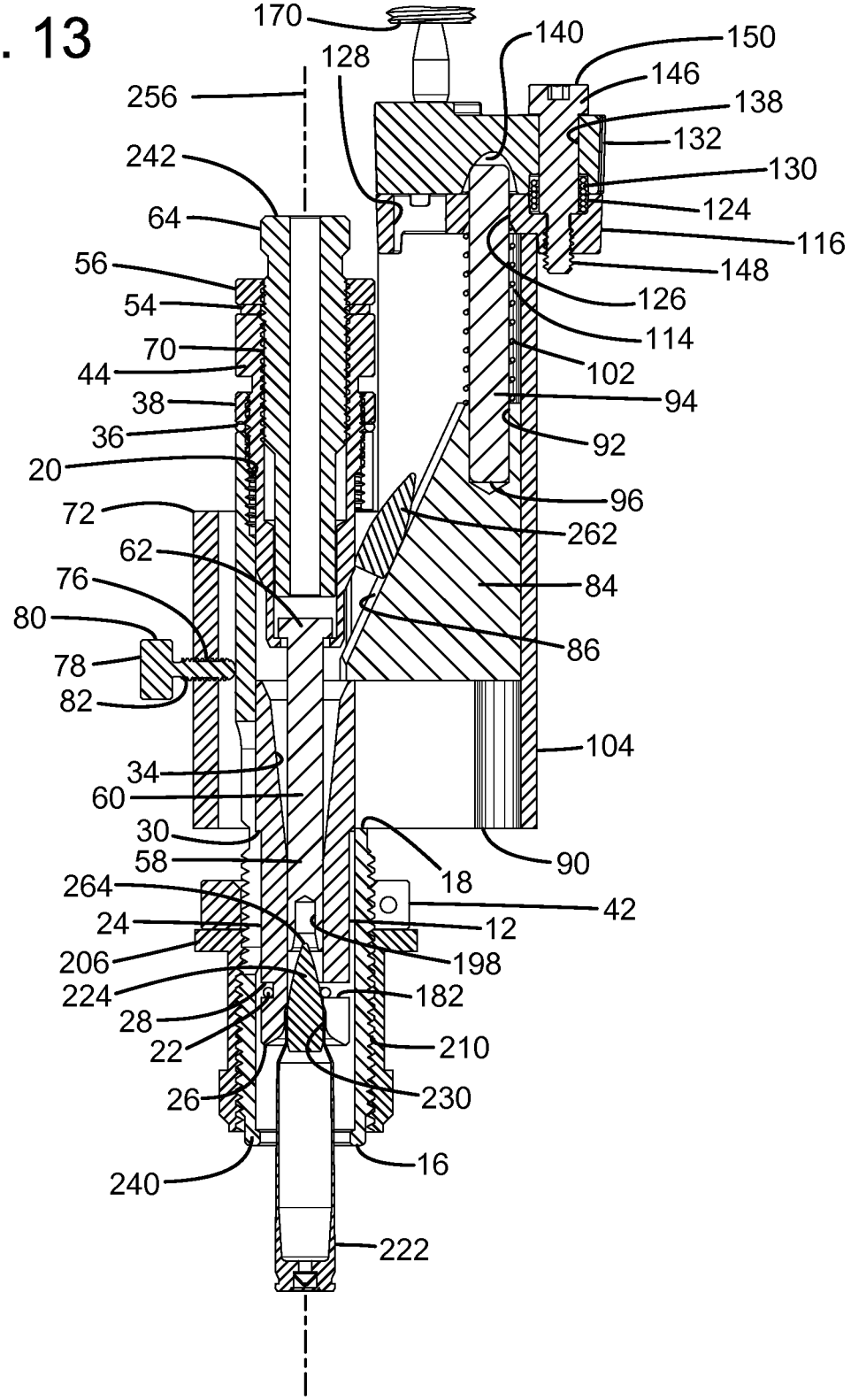
FIG. 13 is a side sectional view of the bullet feed die assembly of FIG. 2 with the reloading press having moved downward relative to FIG. 12 and the seating stem has dropped back into contact with the bottom of the crimp adjust screw.

In FIG. 13, the reloaded case 222 begins to move downward, which permits the alignment sleeve 24 and bullet ramp 84 to also move downward. The head 62 of the seating stem 58 drops back down into contact with the flange 240 formed by the tapered bottom 46 of the crimp adjust screw 44. The feed block 132 is urged back towards the starting position by the torsion spring 130 as the top 98 of the dowel pin 94 interacts with the kidney-shaped opening of hole 140 in the bottom 134 of the feed block. As the bullet ramp moves downward, the next bullet 262 also travels down the sloped surface 86 toward the slot 18 in the die body 12.

Figure 14:
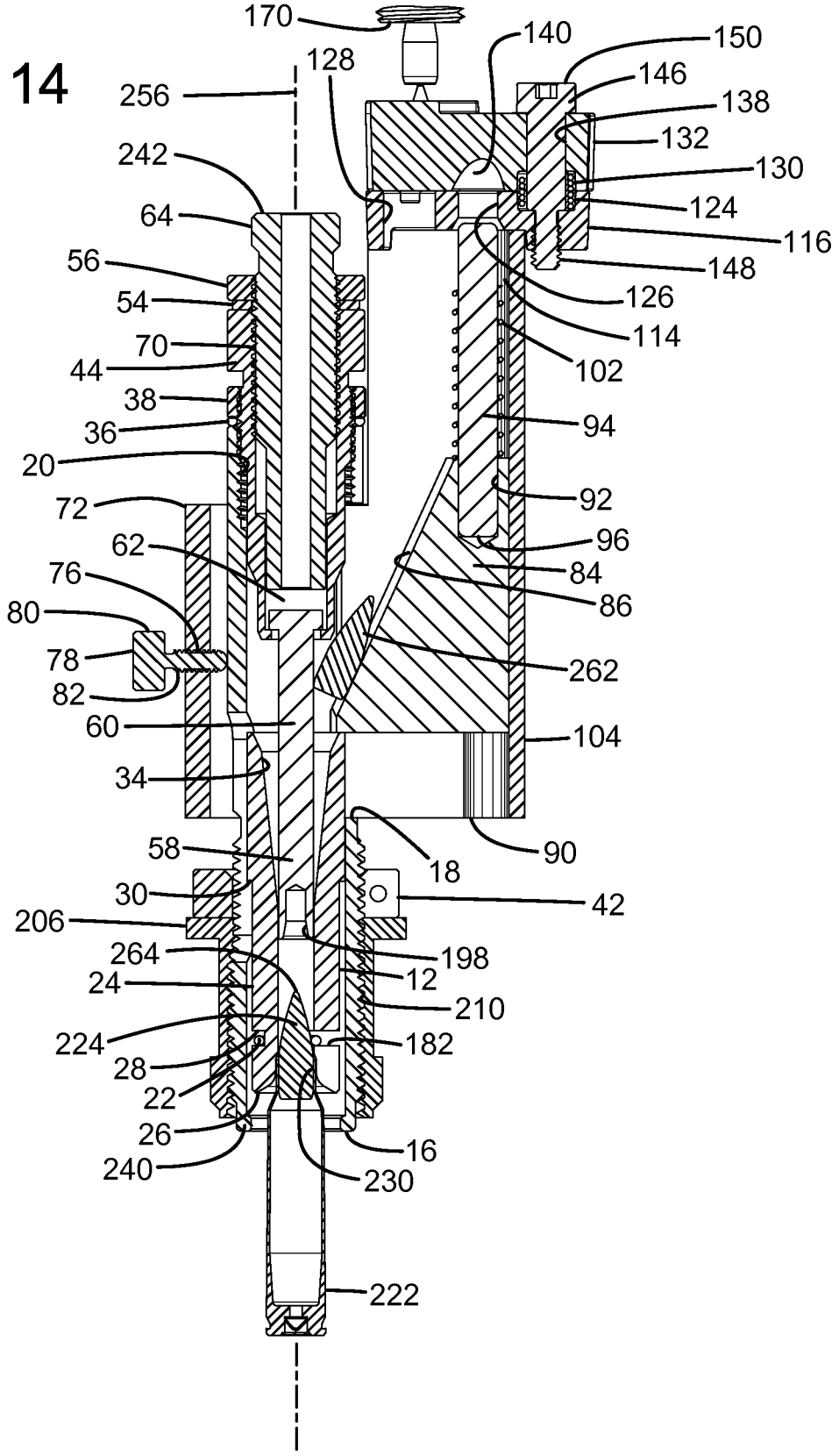
FIG. 14 is a side sectional view of the bullet feed die assembly of FIG. 2 with the reloading press having moved downward relative to FIG. 13 and the feed block has fully rotated back into the position shown in FIG. 2.

In FIG. 14, the reloaded case 222 has moved further downward, which permits the alignment sleeve 24 and bullet ramp 84 to also move further downward. The nose 264 of the new bullet 224 has fully disengaged from the bore 198 in the bottom of the shaft 60 of the seating stem 58. The continued downward movement of the bullet ramp has exposed a sufficient portion of the slot 18 in the die body 12 to permit the next bullet 262 to enter the bore 20 in the die body and contact the shaft of the seating stem. The feed block 132 has pivoted back to the starting position.

Figure 15:
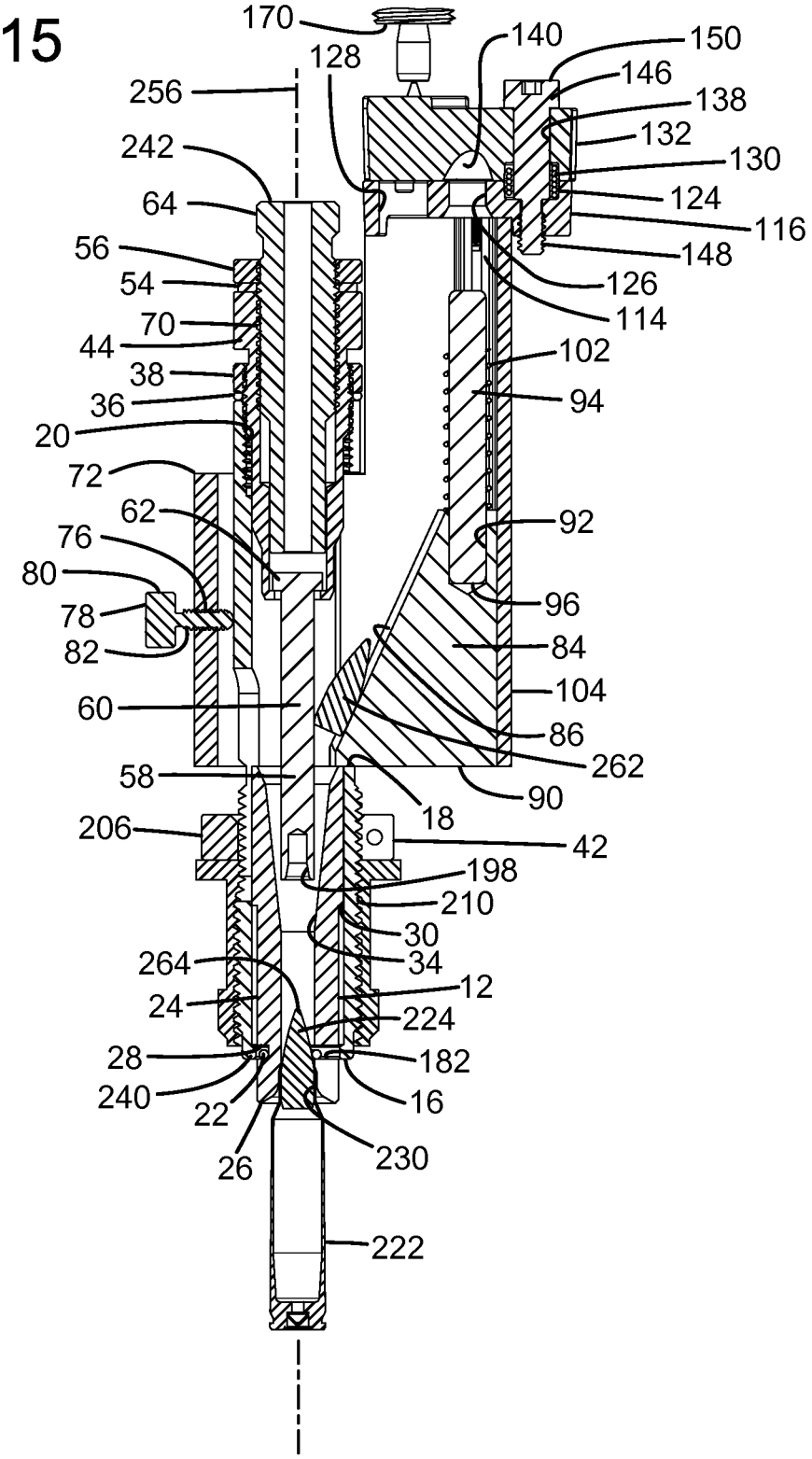
FIG. 15 is a side sectional view of the bullet feed die assembly of FIG. 2 with the reloading press having moved downward relative to FIG. 14 and the bottom of the feed ramp has dropped back into contact with the bottom of the slot in the die body.

In FIG. 15, the reloaded case 222 has moved further downward, which permits the alignment sleeve 24 and bullet ramp 84 to also move further downward. Further downward movement of the bullet ramp is prevented by contact between the die body 12 and the bottom 90 of the bullet ramp. The next bullet 262 has traveled further down the sloped surface 86 of the bullet ramp to the extent permitted by contact with the shaft 60 of the seating stem 58.

Figure 16:
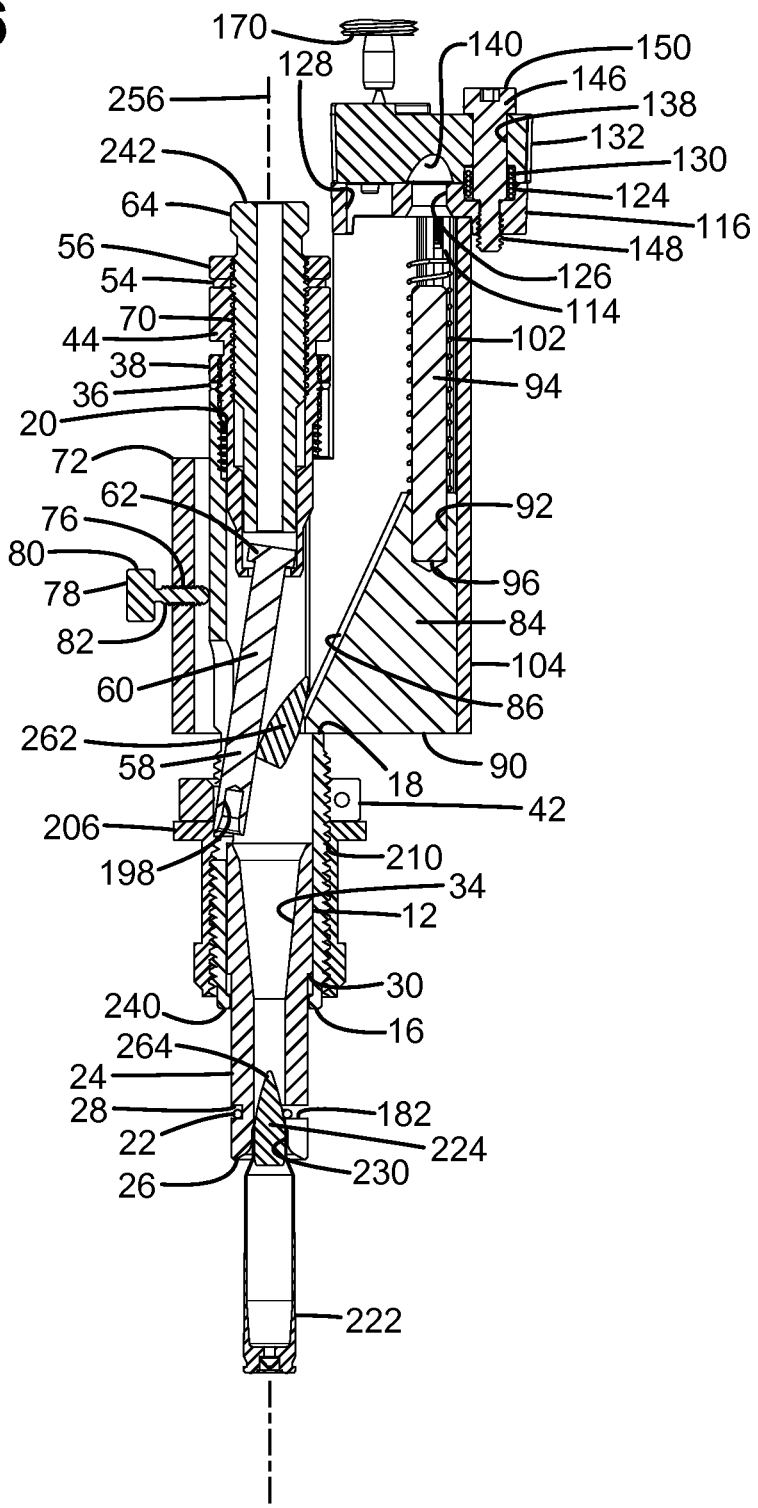
FIG. 16 is a side sectional view of the bullet feed die assembly of FIG. 2 with the reloading press having moved downward relative to FIG. 15 and the seating stem has been pushed aside by the downward travel of the next bullet.

In FIG. 16, the reloaded case 222 has moved further downward, which permits the alignment sleeve 24 to also move further downward. Further downward movement of the alignment sleeve causes the shaft 60 of the seating stem 58 to exit from the top 32 of the bore 34 in the alignment sleeve. The shaft of the seating stem is laterally movable in response to a lateral force such that the next bullet pushes the stem aside upon entering the columnar space 254. Because movement of the shaft of the seating stem is no longer constrained by the alignment sleeve, and the head 62 of the seating stem is not rigidly held by the flange 240 formed by the tapered bottom 46 of the crimp adjust screw 44 (a support element on the primary axis 256 to which the stem is pivotally connected), the next bullet 262 pushes the shaft of the seating stem aside to the extent permitted by the die body 12.

Figure 17:
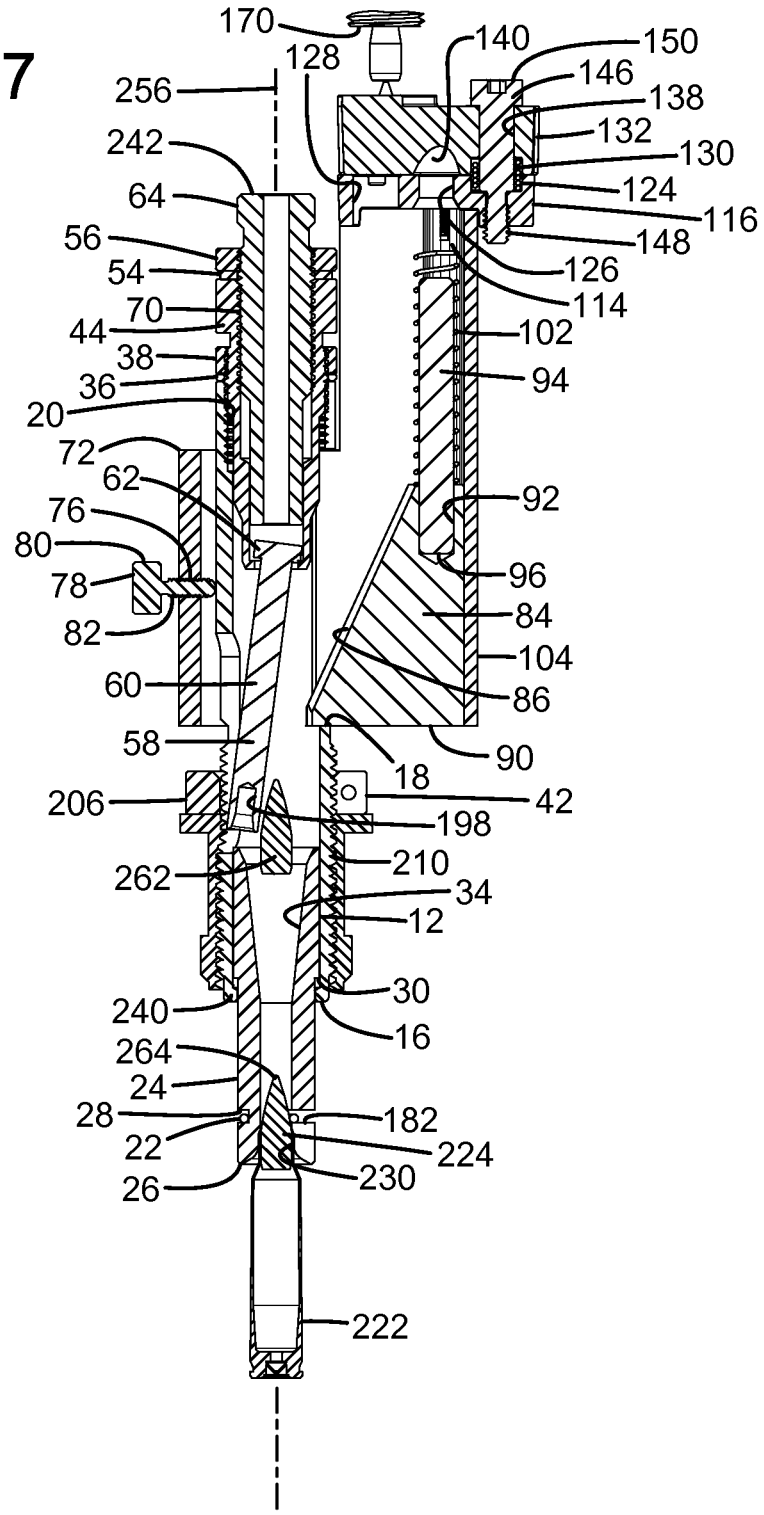
FIG. 17 is a side sectional view of the bullet feed die assembly of FIG. 2 with the reloading press having moved downward relative to FIG. 16 and next bullet has traveled further downward.

In FIG. 17, the deflection of the shaft 60 of the seating stem 58 by the next bullet 262 permits the next bullet to drop off of the sloped surface 86 of the bullet ramp 84 and fall into the bore 34 in the top 32 of the alignment sleeve 24.

Figure 18:
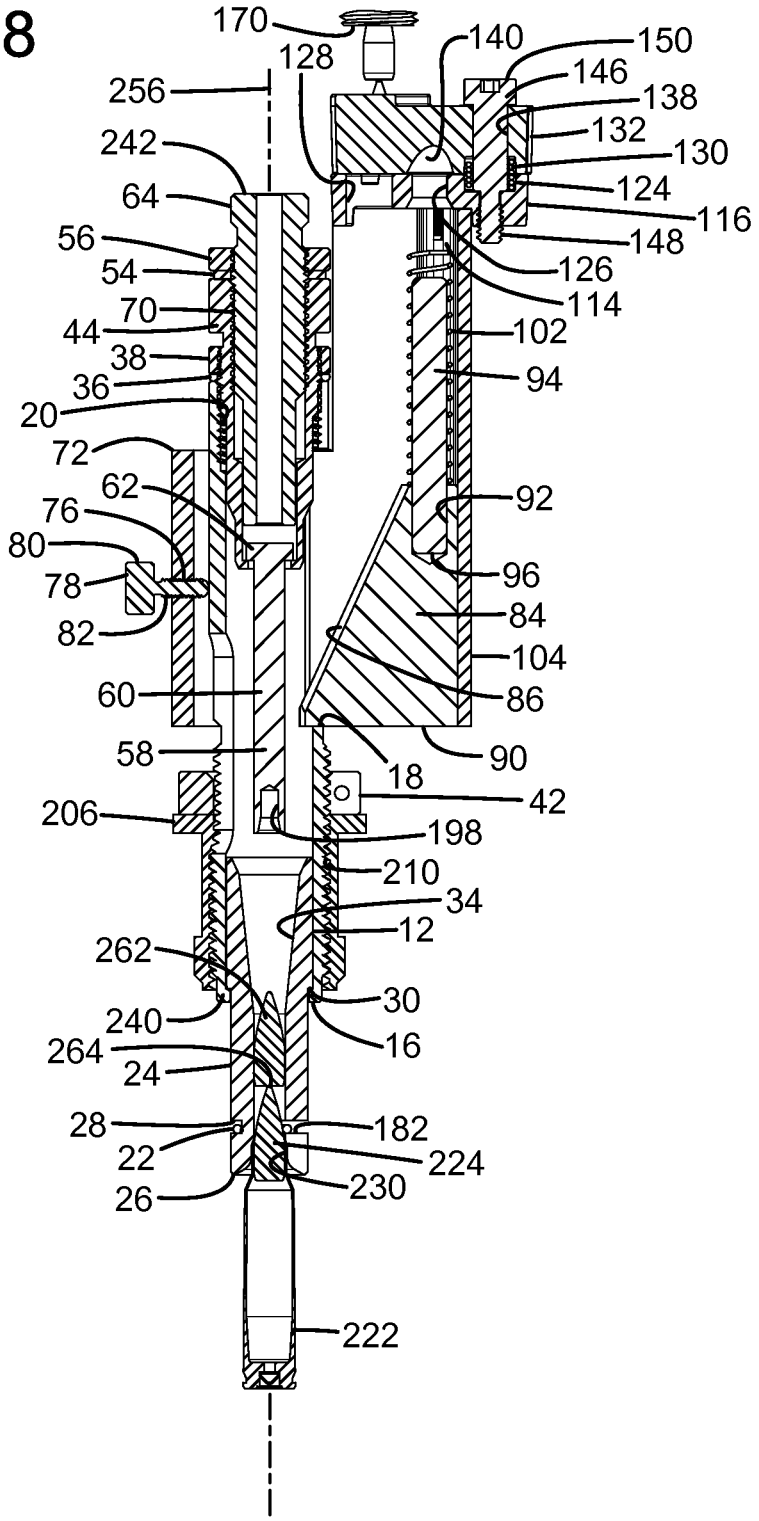
FIG. 18 is a side sectional view of the bullet feed die assembly of FIG. 2 with the reloading press having moved downward relative to FIG. 17 and the bottom of the next bullet has contacted the top of the bullet reloaded into the cartridge.

In FIG. 18, the next bullet 262 has fallen into the bore 34 in the top 32 of the alignment sleeve 24 until the next bullet contacts the nose 264 of the new bullet 224. The seating stem 58 returns to the centered position within the die body 12.

Figure 19:
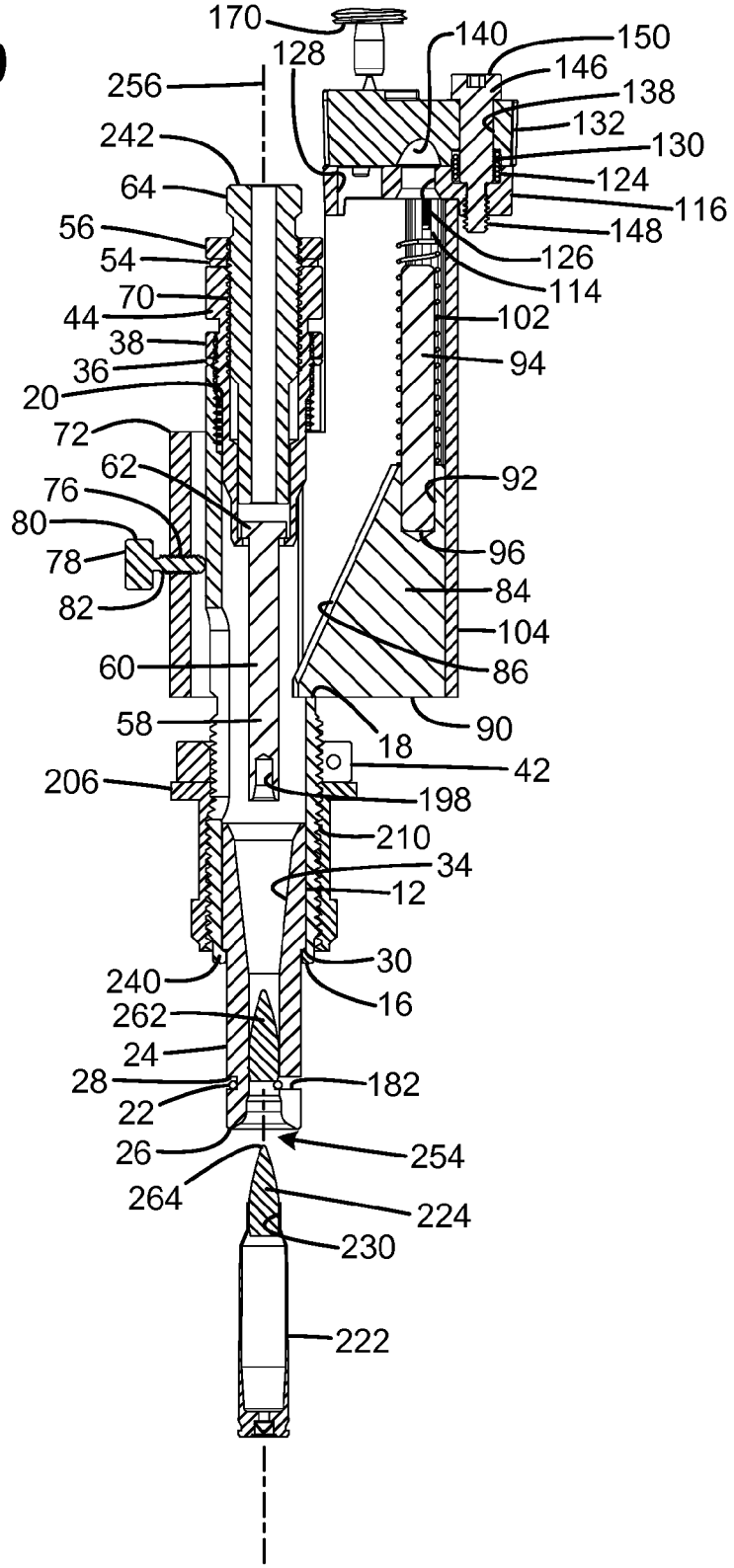
FIG. 19 is a side sectional view of the bullet feed die assembly of FIG. 2 with the reloading press having moved downward relative to FIG. 18 and the bullet reloaded into the cartridge has partially withdrawn from the alignment sleeve.

In FIG. 19, the reloaded case 222 has moved further downward, which permits the alignment sleeve 24 and the next bullet 262 also move further downward. Further downward movement of the alignment sleeve is prevented by contact between the shoulder 30 of the alignment sleeve and the bottom 16 of the die body 12. Further downward movement of the next bullet is prevented by contact with the bullet retaining O-ring 22. The reloaded case 222 exits from the bottom 26 of the alignment sleeve.

Figure 20:
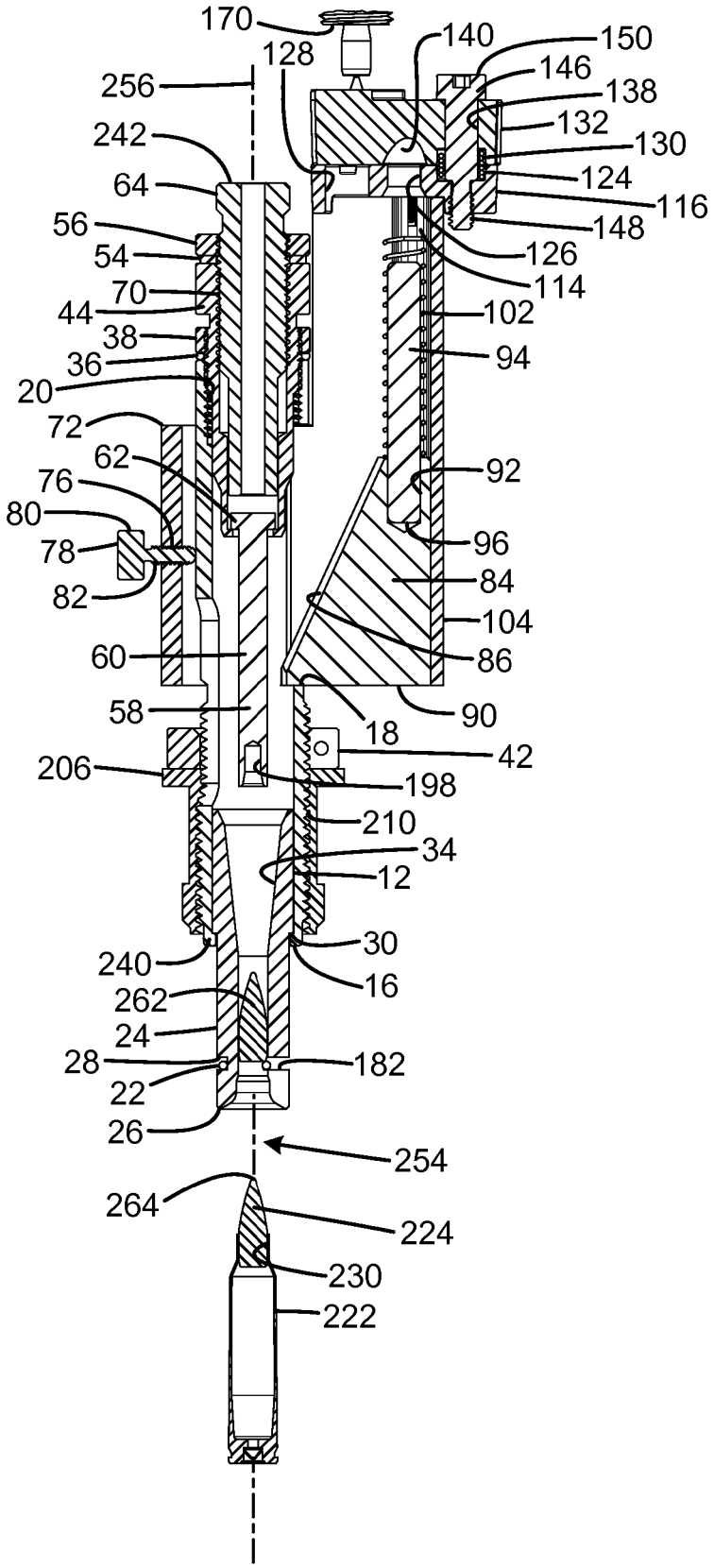
FIG. 20 is a side sectional view of the bullet feed die assembly of FIG. 2 with the reloading press having moved downward relative to FIG. 19 and the bullet reloaded into the cartridge has fully withdrawn from the alignment sleeve, which returns the bullet feed die assembly to the condition shown in FIG. 2.

In FIG. 20, the reloaded case 222 has moved further downward, and the ram 202 of the reloading press 200 reaches the end of the stroke. The bullet fee die assembly 10 has returned to the starting position and is ready to reload a new empty case (not shown).

For ongoing loading operations, the sequence of FIGS. 5-20 is repeated.

While a current embodiment of the bullet feed die assembly has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An ammunition manufacturing machine for inserting a bullet into a case comprising:

a case retention station operable to retain the case in a position defining a columnar space above a casemouth of the case, the columnar space defining a primary axis;

a bullet insertion facility aligned with the primary axis;

the case retention station and bullet insertion facility being relatively movable with respect to each other along the axis between a first separated position and a second proximate position;

the bullet insertion facility including a stem aligned with the primary axis;

the stem having a lower end operable to press the bullet into a mouth of the case; and the lower end of the stem being laterally movable in response to lateral contact by a bullet such that a bullet pushes the stem aside upon entering the columnar space.

2. The machine of claim 1 wherein the bullet insertion facility includes a support element coaxial with the primary axis, and wherein the stem is pivotally connected to the support element.

3. The machine of claim 2 wherein the stem is a rigid elongated member and the support element defines an aperture at a downward-facing lower end, the aperture receiving a portion of the stem.

4. The machine of claim 2 wherein the stem is a rigid elongated member and the support element defines an aperture at a downward-facing lower end, the aperture receiving a portion of the stem.

5. The machine of claim 1 including a bullet feeding facility defining a bullet feed path, the bullet feed path intersecting the primary axis at a position above the lower end of the stem.

6. The machine of claim 1 including a bullet feeding facility defining a bullet feed path, the bullet feed path entering the columnar space at a position above the lower end of the stem.

7. The machine of claim 1 wherein the stem is operable to transmit an axial force, and operable to move in response to a lateral force.

8. The machine of claim 1 wherein the stem is pendular, and wherein the lower end of the stem is coaxial with the primary axis in the absence of a lateral force.

9. The machine of claim 1 wherein the bullet insertion facility includes a support element coaxial with the primary axis, and wherein the stem is pivotally connected to the support element.

10. The machine of claim 1 including a bullet feeding facility defining a bullet feed path, the bullet feed path intersecting the primary axis at a position above the lower end of the stem.

11. The machine of claim 1 including a bullet feeding facility defining a bullet feed path, the bullet feed path entering the columnar space at a position above the lower end of the stem.

12. The machine of claim 1 wherein the stem is operable to transmit an axial force, and operable to move in response to a lateral force.

13. The machine of claim 1 wherein the stem is pendular, and wherein the lower end of the stem is coaxial with the primary axis in the absence of a lateral force.

14. A method of loading a bullet into a case comprising:

positioning a case having a casemouth in alignment with a bullet feeding stem;

feeding a bullet to a position aligned with the casemouth;

feeding the bullet comprising laterally moving the stem;

feeding the bullet including the bullet proceeding to a position entirely below the stem;

the stem moving into alignment with the bullet; and bringing the stem and case toward each other to insert the bullet into the casemouth.

15. The method of claim 14 wherein laterally moving the stem includes angularly displacing the stem.

16. The method of claim 14 wherein laterally moving the stem includes the bullet pushing aside a lower end of the stem.

17. The method of claim 14 wherein laterally moving the stem includes pivoting the stem.

18. The method of claim 14 wherein the stem moving into alignment includes suspending the stem from an upper end such that a lower free end is vertically below an upper end of the stem.

19. The method of claim 14 wherein positioning the case includes positioning the case vertically below the stem.

20. An ammunition manufacturing machine for inserting a bullet into a case comprising:

a case retention station operable to retain the case in a position defining a columnar space above a casemouth of the case, the columnar space defining a primary axis;

a bullet insertion facility aligned with the primary axis;

the case retention station and bullet insertion facility being relatively movable with respect to each other along the axis between a first separated position and a second proximate position; the bullet insertion facility including a stem aligned with the primary axis;

the stem having a lower end operable to press the bullet into a mouth of the case;

the lower end of the stem being laterally movable such that a bullet pushes the stem aside upon entering the columnar space; and the stem being an elongated element defining a stem axis coaxial with the primary axis in the absence of lateral force on the stem.

* * * * *